US005949314A

United States Patent [19]

Spengler et al.

[11] Patent Number: 5,949,314

[45] Date of Patent: Sep. 7, 1999

[54] ELECTROMAGNETIC DRIVE FOR A SWITCH

[75] Inventors: Karin Spengler, Siblingen; Jörg Stamm, Thayngen, both of Switzerland

[73] Assignee: ABB Patent GmbH, Mannheim, Germany

[21] Appl. No.: 09/146,634

[22] Filed: Sep. 3, 1998

[30] Foreign Application Priority Data

Sep. 3, 1997 [DE] Germany ..... 197 38 372

[51] Int. Cl.[6] ..... H01H 67/02

[52] U.S. Cl. ..... 335/128; 335/127; 335/129; 335/131; 335/189; 335/190; 335/274; 335/132

[58] Field of Search ..... 335/6, 127–135, 335/189–191, 203, 255, 274; 200/332, 335

[56] References Cited

U.S. PATENT DOCUMENTS 5,872,497 2/1999 Yerkovich et al. ..... 335/78

*Primary Examiner*—Michael L. Gellner
*Assistant Examiner*—Raymond Barrera
*Attorney, Agent, or Firm*—Herbert L. Lerner; Laurence A. Greenberg

[57] ABSTRACT

An electromagnetic drive for a switch, preferably a motor protective circuit-breaker. The electromagnetic drive has a magnetic system, whose movable armature serves to actuate switching contact elements in the switch. The armature is coupled to a transmission lever by a leaf spring. One end the leaf spring is fixedly clamped and the other end of the leaf spring is connected to the transmission lever in such a way that the transmission lever is actuated when the leaf spring flexes and thus the free end of the leaf spring is displaced.

7 Claims, 1 Drawing Sheet

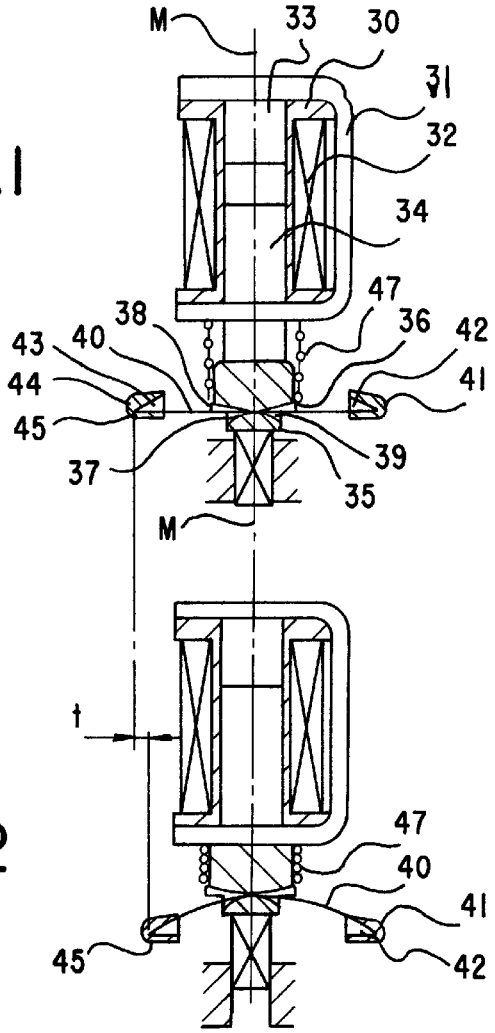
Fig.1
Fig.2
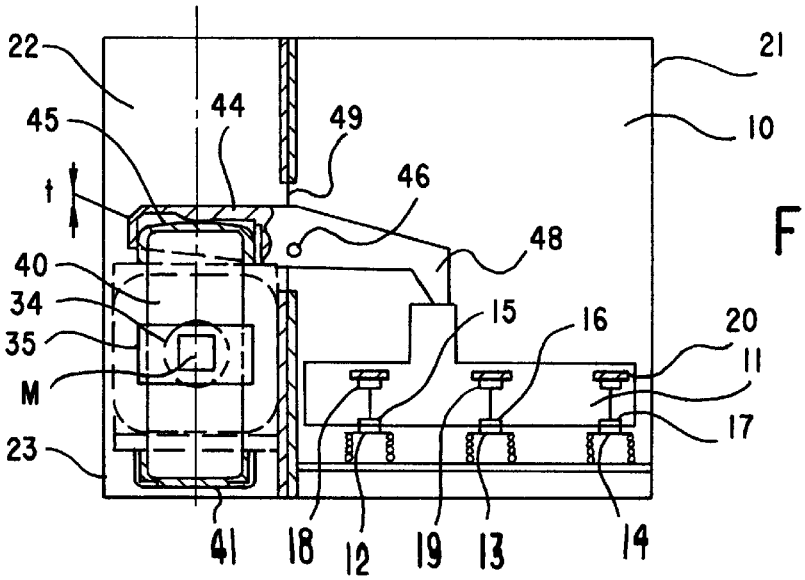
Fig.3

ELECTROMAGNETIC DRIVE FOR A SWITCH

BACKGROUND OF THE INVENTION

1. Field of the Invention

The invention relates to an electromagnetic drive for a switch, preferably a motor protective circuit-breaker. The electromagnetic drive has a magnetic system whose movable armature drives a transmission lever for actuating switching contacts of the switch.

For switch-on and switch-off functions of e.g. motors with relatively high switching frequencies, use is generally made of the combination of a motor protective circuit-breaker and a contactor. The motor protective circuit-breaker being used as a protective element and the contactor as a switching element.

Each of the elements has a contact system, with contact elements made of silver, which is cost-intensive.

It is known to assign a module having a contactor function to a motor protective circuit-breaker module. The principal problems with this configuration reside in transmitting the movement of the armature of the contactor to the motor protective circuit-breaker module. Use is mainly made of toggle lever mechanisms which are expensive to manufacture.

SUMMARY OF THE INVENTION

It is accordingly an object of the invention to provide an electromagnetic drive for a switch which overcomes the hereinafore-mentioned disadvantages of the heretofore-known devices of this general type, in which a reduction in the number of contact elements is achieved and the production costs are reduced.

With the foregoing and other objects in view there is provided, in accordance with the invention, in combination with a switch having a movable contact carrier and switching contacts, an electromagnetic drive, including: a transmission lever disposed so as to selectively actuate the switching contacts of the switch; a magnetic system having a movable armature connected to and driving the transmission lever for actuating the switching contacts of the switch; a leaf spring coupling the movable armature to the transmission lever, the leaf spring having a leaf extent extending transversely with respect to a direction of movement of the movable armature, the leaf spring having a fixedly clamped first end and a second end coupled to the transmission lever resulting in the transmission lever being driven when the leaf spring flexes.

The inventive electromagnetic drive for a switch has a magnetic system whose movable armature drives a transmission lever for the actuation of switching contacts in the switch. The invention is distinguished by the fact that the armature is coupled to the transmission lever by the leaf spring. The leaf extent of the leaf spring runs transversely with respect to the direction of the armature movement. As a result, only a simple element is necessary with which the linear movement of the armature of the magnetic system is transmitted to the movement of the transmission lever, instead of having to use a complicated toggle lever joint system.

The transmission lever is advantageously a pivoting lever whose pivot axis runs perpendicularly to the movement of the free end of the leaf spring, and, in accordance with a further construction, the pivot axis can also run parallel to the direction of movement of the armature.

In accordance with an added feature of the invention, the transmission lever is a double-arm lever having a first arm and a second arm, the first arm interacting with the leaf spring, and the second arm interacting with the switching contact carrier for the movable contact elements of the switch.

In accordance with an additional feature of the invention, the transmission lever pivots about a pivot axis, and including a module receiving the magnetic system and the transmission lever.

In accordance with another feature of the invention, there is a housing accommodating the magnetic system and the transmission lever, and the housing is configured to be attached to the switch.

In accordance with a concomitant feature of the invention, the switch is a motor protective circuit-breaker.

Other features which are considered as characteristic for the invention are set forth in the appended claims.

Although the invention is illustrated and described herein as embodied in an electromagnetic drive for a switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a cross-sectional view of a magnetic armature system with a leaf spring in a first position according to the invention;

FIG. 2 is a cross-sectional view of the system in a second position; and

FIG. 3 is an illustration of the system in a motor protective circuit-breaker in an OFF position.

DESCRIPTION OF THE PREFERRED EMBODIMENTS

Referring now to the figures of the drawing in detail and first, particularly, to FIG. 3 thereof, there is shown a motor protective circuit-breaker 10. A movable switching contact carrier 11 is disposed in the motor protective circuit-breaker 10. Mounted on the movable switching contact carrier 11 are contact bridges 12, 13 and 14 whose contact elements 15, 16 and 17 interact with stationary contact elements 18, 19 and 20.

The motor protective circuit-breaker 10, which is accommodated in a housing 21, is assigned a drive 22, or is attached to the drive 22, which is likewise accommodated in a dedicated drive housing 23. The components illustrated in FIGS. 1 and 2 are situated in the drive housing 23.

FIGS. 1 and 2 show an electromagnetic system 30 having a U-shaped yoke 31 and a coil 32 which includes a stationary core 33 and a movable armature 34. A transmission element 35 is fitted on the outwardly projecting free end of the armature 34. In the transmission element 35, running transversely with respect thereto, a perforation 36 is accommodated which, in the central region, that is to say in the region of the central axis M—M of the electromagnetic system 30, has a constriction 37 and respective trumpet-shaped extensions 38 and 39 at the two opposite ends. The clear width of the constriction 37 corresponds to the thickness of a leaf spring 40, which penetrates the perforation 36 transversely with respect to the central axis M—M and with its leaf spring plane perpendicular thereto and is guided in the perforation 36. The trumpet-shaped extensions 38 and 39 are to be dimensioned such that they can readily allow flexing of the leaf spring 40 into the shape shown in to FIG. 2.

One end of the leaf spring 40, the end drawn on the right in the drawing of FIG. 1, is held, in the drive housing 23, in a clamp 41 having a wedge-shaped opening 42. The wedge shape of which is matched to the movement of the leaf spring 40.

The other end of the leaf spring 40, that is to say the end situated on the left in FIG. 1, engages in an opening 43 (corresponding to the opening 42) of a further clamp 45 which forms one arm of a double-arm lever 44. The double-arm lever 44 penetrates through an opening 49 formed in the housings 21 and 23 and is pivotably mounted in the housing 23 on a pivot axis 46. The pivot axis 46 runs parallel to the central axis M—M and perpendicularly to the leaf spring extent. The lever 44 is a double-arm lever whose end 48, situated inside the housing 21 of the motor protective circuit-breaker 10, is angled away in an L-shaped manner and acts on the switching contact carrier 11, with the result that the contact elements 15, 18; 16, 19; 17, 20 can be closed or opened in the event of actuation.

FIG. 1 shows the leaf spring 40 in a straight or rectilinear position.

When the electromagnetic system 30 is excited, the armature 34 is pulled into the interior of the coil 32 toward the core 33, as a result of which the leaf spring 40 is flexed. The right-hand end of the leaf spring 40 remains in the opening 42 and the left-hand end is displaced from the position of FIG. 1 by the value t into the position according to FIG. 2. As a result of which the further clamp 45 of the double-arm lever 44 is pivoted in a counter clockwise direction with respect to the central axis. Depending on the side on which the contact elements 18 to 20 are situated, the contact points in the motor protective circuit-breaker 10 can be opened or closed in this way.

In the case of the configuration illustrated in FIG. 3, the contact elements are closed.

A compression spring 47, which constantly seeks to force the armature 34 out from the coil 32, is situated between the yoke 31 and the driver part (transmission element) 35. The leaf spring 40 is thus constantly pressurized in the direction of bending back from the curved position according to FIG. 2 into the rectilinear position according to FIG. 1; the switching contact carrier or bridge 11 thus moves into the OFF position.

The wedge shape of the openings 42 and 43 is asymmetrical and dimensioned such that the leaf spring 40 is enabled to flex from the position according to FIG. 1 into the position according to FIG. 2. Accordingly, the wedge surface which is remote from the electromagnetic system 30 is oriented perpendicular to the direction of movement of the armature 34 and parallel to the leaf spring 40, whereas the inclined surface of the wedge shape lies on the side facing the magnetic system 30.

It goes without saying that the leaf spring 40 can also be actuated in the opposite direction. In this manner the leaf spring 40 would be flexed in the deenergized state of the electromagnetic system 30 and rectilinear in the excited state. This would necessitate a different configuration of the fixed contact elements 18 to 20 with respect to the movable contact elements 15 to 17. Likewise, the wedge shape of the openings would be the other way round and likewise matched to the bent-out form of the leaf spring 40.

FIG. 3 shows that the pivot 46 is situated inside the module 22. Of course, it is also possible to shift the pivot into the motor protective circuit-breaker 10.

We claim:

1. In combination with a switch having a movable contact carrier and switching contacts, an electromagnetic drive, comprising:

a transmission lever disposed so as to selectively actuate the switching contacts of the switch;

a magnetic system having a movable armature connected to and driving said transmission lever for actuating the switching contacts of the switch; and a leaf spring coupling said movable armature to said transmission lever, said leaf spring having a leaf extent extending transversely with respect to a direction of movement of said movable armature, said leaf spring having a fixedly clamped first end and a second end coupled to said transmission lever for driving said transmission lever when said leaf spring flexes.

2. The drive according to claim 1, wherein said transmission lever is a pivoting lever pivoting about a pivot axis extending perpendicularly to a movement of said second end of said leaf spring.

3. The drive according to claim 1, wherein said transmission lever pivots about a pivot axis extending parallel to the direction of movement of said movable armature.

4. The drive according to claim 1, wherein said transmission lever is a double-arm lever having a first arm and a second arm, said first arm interacting with said leaf spring, and said second arm interacting with the switching contact carrier of the switch.

5. The drive according claim 1, wherein said transmission lever pivots about a pivot axis, and including a module receiving said magnetic system and said transmission lever.

6. The drive according to claim 1, including a housing accommodating said magnetic system and said transmission lever and configured to be attached to the switch.

7. The drive according to claim 1, wherein the switch is a a motor protective circuit-breaker.

* * * * *